US010722945B2

(12) United States Patent
Gao et al.

(10) Patent No.: US 10,722,945 B2
(45) **Date of Patent: *Jul. 28, 2020**

(54) FLEXIBLE POROUS METAL FOIL AND PREPARATION METHOD THEREFOR

(71) Applicant: INTERMET TECHNOLOGIES CHENGDU CO., LTD, Sichuan (CN)

(72) Inventors: Lin Gao, Chengdu (CN); Tao Wang, Chengdu (CN); Tao Wang, Chengdu (CN); Bo Li, Chengdu (CN)

(73) Assignee: Intermet Technologies Chengdu Co., Ltd., Chengdu, Sichuan (CN)

( * ) Notice: Subject to any disclaimer, the term of this patent is extended or adjusted under 35 U.S.C. 154(b) by 250 days.

This patent is subject to a terminal disclaimer.

(21) Appl. No.: 15/523,044

(22) PCT Filed: Oct. 31, 2015

(86) PCT No.: PCT/CN2015/093483

§ 371 (c)(1),
(2) Date: Apr. 28, 2017

(87) PCT Pub. No.: WO2016/066140

PCT Pub. Date: May 6, 2016

(65) Prior Publication Data

US 2017/0333992 A1 Nov. 23, 2017

(30) Foreign Application Priority Data

Oct. 31, 2014 (CN) ..... 2014 1 0608980

(51) Int. Cl.
*B22F 3/11* (2006.01)
*B22F 3/10* (2006.01)
(Continued)

(52) U.S. Cl.
CPC ..... *B22F 3/11* (2013.01); *B22F 1/0074* (2013.01); *B22F 3/1017* (2013.01);
(Continued)

(58) Field of Classification Search
None
See application file for complete search history.

(56) References Cited

U.S. PATENT DOCUMENTS

2007/0029251 A1* 2/2007 Lee ..... B01D 67/0041 210/500.25
2007/0202001 A1* 8/2007 Stoumaras ..... B01D 39/2044 419/9

(Continued)

FOREIGN PATENT DOCUMENTS

CN 1942270 A 4/2007

*Primary Examiner* — David Sample
*Assistant Examiner* — Elizabeth Collister
(74) *Attorney, Agent, or Firm* — Mersenne Law

(57) ABSTRACT

A piece of flexible porous metal foil is a sheet made of porous metal material using solid solution alloy, face-centered cubic metal simple substance or body-centered cubic metal simple substance as matrix phase. The thickness of the sheet is 5 to 200 micrometers, the average aperture thereof is 0.05 to 100 micrometers, the porosity thereof is 15-70%, and the sheet is made by sintering a homogeneous film. The preparation method for the flexible porous metal foil comprises: (1) preparing thick turbid liquid with raw material powder forming the metal porous material by using dispersing agent and binding agent; (2) injecting the turbid liquid into a mold cavity of a film manufacturing fixture, and drying the turbid liquid to form a piece of homogeneous film; (3) putting the film into a sintering manufacturing fixture matching with the film in shape, then sintering the film, and taking the film out after sintering and obtaining the flexible porous metal foil. The flexible porous metal foil
(Continued)

made by the above method can be used in many fields, and have ideal performance in flexible and chemical stability.

9 Claims, 1 Drawing Sheet

(51) Int. Cl.

| | |
|---|---|
| ***B22F 1/00*** | (2006.01) |
| ***B22F 3/22*** | (2006.01) |
| ***B22F 5/00*** | (2006.01) |
| ***C22C 19/03*** | (2006.01) |

(52) U.S. Cl.
CPC ..... *B22F 3/1021* (2013.01); *B22F 3/225* (2013.01); *B22F 5/006* (2013.01); *C22C 19/03* (2013.01); *B22F 2003/1042* (2013.01); *B22F 2301/15* (2013.01); *B22F 2998/10* (2013.01)

(56) References Cited

U.S. PATENT DOCUMENTS

2011/0155662 A1 6/2011 Liu et al.
2011/0206944 A1* 8/2011 Uhlenhut ..... B22F 3/22
428/613

* cited by examiner

FLEXIBLE POROUS METAL FOIL AND PREPARATION METHOD THEREFOR

TECHNICAL FIELD

The present invention relates to a sintered metal porous material and preparation thereof, and specifically relates to a flexible porous metal foil and a preparation method thereof.

BACKGROUND

The sintered metal porous material is mainly used as a filter material. In specific application, the sintered metal porous material is made into a filter element in certain shape and structure. The existing sintered metal porous material filter elements are substantially of a tubular or plate-type structure. Their preparation principles are similar. i.e., roughly, raw powder constituting the metal porous material is pressed into a tubular or plate-type compact via a special mold (generally adopting an isostatic pressing technology), and then the compact is sintered to obtain a product.

The application range of the above tubular or plate-type sintered metal porous material filter element is limited due to the influence of its shape, structure and corresponding attendant requirements for filter devices and systems. However, the inventor of the present application discovers that the sintered metal porous material filter element has stronger advantages than conventional filter elements (e.g., organic filter membranes) on the aspects of chemical erosion resistance, material irreversible pollution resistance, mechanical strength and the like, so it is significant to develop a novel sintered metal porous material filter element capable of correspondingly substituting original filter elements in many fields. Based on the background, the applicant creatively proposed and developed a flexible porous metal foil, i.e., a sheet which is made of a metal porous material, can be bent relatively freely and even can be folded.

The paper "Research Development on Ti—Al Intermetallic Compound Porous Material, Jiang Yao et al., Chinese Material Development, Vol. 29, No. 3. March 2010" in section 2.3 describes a preparation process of a Ti—Al intermetallic compound paper membrane. The paper membrane made of a Ti—Al intermetallic compound is still a rigid material.

SUMMARY OF THE INVENTION

The technical problems to be solved by the present invention are to respectively provide two flexible porous metal foils and preparation methods of the flexible porous metal foils. The present invention secondly provides a membrane making fixture and a membrane sintering fixture for the above preparation methods of the flexible porous metal foils, so that the flexible porous metal foils are easier to manufacture and the product quality can also be better guaranteed.

Of course, as for the above membrane making fixture and the membrane sintering fixture, the "membrane" is not only the "membrane" obtained in the preparation methods of the flexible porous metal foils of the present invention. For example, the membrane sintering fixture can be used for sintering the "paper membrane" mentioned in the background of the invention.

The first flexible porous metal foil provided by the present invention is a sheet made of a metal porous material using a solid solution alloy, a face-centered cubic elemental metal or a body-centered cubic elemental metal as the matrix phase. The thickness of the sheet is 5~200 μm, the average aperture is 0.05~100 μm, the porosity is 15%~70%, and the sheet is formed by sintering a homogeneous membrane. Specifically, firstly, the flexible porous metal foil is made of metal using a solid solution alloy, a face-centered cubic elemental metal or a body-centered cubic elemental metal as the matrix phase on material components, so that the flexibility of the flexible porous metal foil is ensured and it can be prepared by the following corresponding preparation method of the present invention. Secondly, the metal material for forming the flexible porous metal foil shall be a porous material, and its pore structure is characterized in that the average aperture is 0.05~100 μm and the porosity is 15%~70%, so that the flexible porous metal foil can meet extensive requirements of filter separation. In addition, the thickness of the flexible porous metal foil (sheet) is 5~200 μm, generally 10~60 μm. More importantly, the flexible porous metal foil is formed by sintering a homogeneous membrane. The so-called "homogeneous" expresses that the components of the membrane are roughly uniform, i.e., substantially differs from the aluminum foil after coating and before reactive synthesis as mentioned in the background "Research Development on Ti—Al Intermetallic Compound Porous Material". The aluminum foil after coating and before reactive synthesis can be understood as an asymmetrical sheet. The meaning of "asymmetrical" in the field of sintered metal porous materials is general. The "homogeneous" in the present invention is a distinguishing concept proposed relative to "asymmetrical". Since the flexible porous metal foil of the present invention is formed by sintering a homogeneous membrane, the foil is more uniform in aperture distribution, better in flatness and the like.

The sheet may be made of a metal porous material using an infinite solid solution alloy as the matrix phase. For example, the sheet is made of a metal porous material using Ag—Au solid solution, Ti—Zr solid solution, Mg—Cd solid solution or Fe—Cr solid solution as the matrix phase. For another example, the sheet is preferably made of a Ni—Cu solid solution metal porous material, which can require that the aperture differences of more than 75% of numerous pores of the porous material are in the range of less than 70 μm. In addition, the Ni—Cu solid solution alloy porous material is relatively ideal on the aspects of flexibility (can be folded multiple times), chemical stability and the like, and the permeability of the sintered porous material is also excellent, so the application range is relatively wide.

The sheet may also be made of a metal porous material using a finite solid solution alloy as the matrix phase. For example, the sheet is made of a metal porous material using Cu—Al solid solution, Cu—Zn solid solution or Fe—C—Cr solid solution as the matrix phase. The sheet may also be made of a metal porous material having a face-centered cubic structure and using Al, Ni, Cu or Pb as the matrix phase. The sheet may also be made of a metal porous material having a body-centered cubic structure and using Cr, W, V or Mo as the matrix phase.

The above flexible porous metal foil of the present invention has a wide application space, e.g., in industry, can be used for waste heat recovery, agent recovery and pollution control in the textile and leather industry, purification, concentration, sterilization and byproduct recovery in the food processing industry, artificial trachea, controlled release, blood filtration and water purification in the medicine and health-care industry and filters in the vehicle industry, and in civil use, can be used as a dust filter material for masks and a curtain material having an electrostatic dust collection function.

A preparation method of the above flexible porous metal foil of the present invention includes the steps of: (1) preparing a viscous suspension from raw powder constituting a metal porous material by using a dispersant and an adhesive; (2) injecting the suspension into a mold cavity of a membrane making fixture, and drying the suspension to form a homogeneous membrane; and (3) charging the membrane into a sintering fixture matched with the membrane in shape, then performing constrained sintering, and taking the flexible porous metal foil out of the sintering fixture and obtaining the foil after sintering.

In the above method, if the flexible porous metal foil is made of a metal porous material of Ni—Cu solid solution, in order to prepare a high-performance Ni—Cu flexible porous metal foil, in step (1), Ni powder and Cu powder are mixed uniformly first to form raw powder mixture, wherein the mass of the Cu powder is 30~60% of that of the mixture, then PVB (Polyvinyl Butyral) serving as an adhesive is added into ethanol serving as a dispersant in a mass ratio of PVB to ethanol being (0.5~5):100 to form a PVB solution, next, the mixture is added into the PVB solution according to a proportion of adding 20~50 g of the mixture into per 100 ml of ethanol, the mixture is dispersed uniformly by stirring, and a viscous suspension is thus obtained; and in step (3), the sintering process includes a first sintering stage of gradually raising the sintering temperature to 520~580° C. with the holding time of 60~180 mins and a second sintering stage of directly raising the temperature to 1130~1180° C. with the holding time of 120~300 mins at the heating rate of ≥5° C./min after the first stage.

The membrane making fixture available for the above method includes a fixing portion, an adjusting portion and a movable portion, wherein the fixing portion includes a mold frame for forming the edge of the membrane; the adjusting portion includes a template matched with the mold frame and used for forming the bottom of the membrane, and the template is connected with adjusting devices enabling the template to move in the depth direction of the mold frame; and the movable portion includes a scraper positioned on the top surface of the mold frame and having the cutting edge flush with the top surface of the mold frame in the working process. The membrane making fixture can control the thickness of the membrane relatively accurately, and ensures the thickness uniformity and surface flatness of the membrane.

As a specific embodiment of the adjusting device, the adjusting device includes a height adjusting mechanism which is fixed relative to the mold frame and connected with one of four corners of the bottom of the template and works independently. The heights of four corners of the template can be adjusted respectively, so that the overall template is ensured to parallel to the top surface of the mold frame, and the thickness uniformity of the membrane is higher.

In addition, a lubricant coating volatile at 580° C. is further arranged on the molding surface of the mold frame and the molding surface of the template. The lubricant coating may be specifically a Vaseline coating. In this case, the molded membrane can be successfully taken out of the membrane making fixture and prevented from being stuck to the mold, and simultaneously, the volatile lubricant coating does not influence the components of the subsequent prepared flexible porous metal foil and is beneficial to improving the porosity of the flexible porous metal foil.

The membrane sintering fixture available for the above method includes an upper mold, a lower mold and a side mold made of high temperature resistant materials, and the upper mold and the lower mold are respectively matched with the side mold to form the mold cavity matched with the internal membrane; the mold cavity is connected with an exhaust structure for emitting sintered volatile matters, and the exhaust structure is a fit clearance reserved at the fit part of the upper mold and the side mold and/or a fit clearance reserved at the fit part of the lower mold and the side mold and/or an air hole formed in at least one of the upper mold, the lower mold and the side mold. Constrained sintering can be performed on the membrane via the sintering fixture, thus preventing deformation of the membrane during sintering procedure.

As a preferred specific structure of the upper mold, the lower mold and the side mold, the side mold is a mask, the upper mold and the lower mold are respectively clamping plates, at least three layers of clamping plates are installed in the mask, and the mold cavity is formed between any two adjacent layers of clamping plates. In this case, a plurality of membranes can be sintered simultaneously, so that the production efficiency is improved and the sintering consistency is also ensured.

Besides, an alumina coating is further arranged on the surface, contacting the membrane, of each of the upper mold, the lower mold and the side mold. Alumina can block mutual diffusion of elements between the material of the sintering fixture itself and the membrane material in the high-temperature sintering process.

At least one of the upper mold, the lower mold and the side mold can be made of graphite. The graphite has good high temperature resistance, and the graphite having a smooth surface facilitates de-molding of the product after sintering.

The second flexible porous metal foil provided by the present invention is a sheet made of a metal porous material using a solid solution alloy as the matrix phase, the thickness of the sheet is 5~200 μm, the average aperture is 0.05~100 μm, and the porosity is 156%~70%. Specifically, the flexible porous metal foil is made of metal using a solid solution alloy as the matrix phase on material components, so that the flexibility of the flexible porous metal foil is ensured. Secondly, the metal material for forming the flexible porous metal foil is a porous material, and its pore structure is characterized in that the average aperture is 0.05~100 μm and the porosity is 15%~70%, so that the flexible porous metal foil can meet extensive requirements of filter separation. In addition, the thickness of the flexible porous metal foil (sheet) is 5~200 μm, generally 10~60 μm.

The sheet may be made of a metal porous material using an infinite solid solution alloy as the matrix phase. For example, the sheet is made of a metal porous material using Ag—Au solid solution, Ti—Zr solid solution, Mg—Cd solid solution or Fe—Cr solid solution as the matrix phase. For another example, the sheet is preferably made of a Ni—Cu solid solution alloy porous material, and the Ni—Cu solid solution alloy porous material is relatively ideal on the aspects of flexibility (can be folded multiple times), chemical stability and the like, so the application range is relatively wide.

The sheet may also be made of a metal porous material using a finite solid solution alloy as the matrix phase. For example, the sheet is made of a metal porous material using Cu—Al solid solution, Cu—Zn solid solution or Fe—C—Cr solid solution as the matrix phase.

The above second flexible porous metal foil of the present invention, in industry, can be used for waste heat recovery, agent recovery and pollution control in the textile and leather industry, purification, concentration, sterilization and byproduct recovery in the food processing industry, artificial trachea, controlled release, blood filtration and water purification in the medicine and health-care industry and filters in the vehicle industry, and in civil use, can be used as a dust filter material for masks and a curtain material having an electrostatic dust collection function.

A preparation method of the second flexible porous metal foil of the present invention includes the steps of: (1) preparing a carrier, wherein the carrier is a foil formed by a certain element or a few elements in a metal porous material for forming the flexible porous metal foil; (2) preparing a viscous suspension from raw powder of the remaining elements constituting the metal porous material by using a dispersant and an adhesive; (3) coating the surface of the carrier with the suspension, and drying the suspension to form a membrane attached to the surface of the carrier; and (4) charging the carrier carrying the membrane into a sintering fixture matched with the carrier in shape, then performing constrained sintering, and taking the flexible porous metal foil out of the sintering fixture.

The membrane making fixture used for the above preparation method of the second flexible porous metal foil includes a fixing portion, an adjusting portion and a movable portion, wherein the fixing portion includes a mold frame for forming the edge of the membrane; the adjusting portion includes a template matched with the mold frame and used for placing the carrier, and the template is connected with adjusting devices enabling the template to move in the depth direction of the mold frame; and the movable portion includes a scraper positioned on the top surface of the mold frame and having the cutting edge flush with the top surface of the mold frame in the working process. The membrane making fixture can control the thickness of the membrane relatively accurately, and ensures the thickness uniformity and surface flatness of the membrane.

As a specific embodiment of the adjusting device, the adjusting device includes a height adjusting mechanism which is fixed relative to the mold frame and connected with one of four corners of the bottom of the template and works independently. The heights of four corners of the template can be adjusted respectively, so that the overall template is ensured to parallel to the top surface of the mold frame, and the thickness uniformity of the membrane is higher.

The sintering fixture used for the above preparation method of the second flexible porous metal foil includes an upper mold, a lower mold and a side mold made of high temperature resistant materials, and the upper mold and the lower mold are respectively matched with the side mold to form a mold cavity matched with the carrier carrying the membrane; the mold cavity is connected with an exhaust structure for emitting sintered volatile matters, and the exhaust structure is a fit clearance reserved at the fit part of the upper mold and the side mold and/or a fit clearance reserved at the fit part of the lower mold and the side mold and/or an air hole formed in at least one of the upper mold, the lower mold and the side mold. Constrained sintering can be performed on the carrier carrying the membrane via the sintering fixture, thus preventing deformation of the membrane during sintering procedure.

As a preferred specific structure of the upper mold, the lower mold and the side mold, the side mold is a mask, the upper mold and the lower mold are respectively clamping plates, at least three layers of clamping plates are installed in the mask, and the mold cavity is formed between any two adjacent layers of clamping plates. In this case, a plurality of carriers carrying membranes can be sintered simultaneously, so that the production efficiency is improved and the sintering consistency is also ensured.

Besides, an alumina coating is further arranged on the surface, contacting the membrane, of each of the upper mold, the lower mold and the side mold. Alumina can block mutual diffusion of elements between the material of the sintering fixture itself and the membrane material in the high-temperature sintering process.

At least one of the upper mold, the lower mold and the side mold is made of graphite. The graphite has good high temperature resistance, and the graphite having a smooth surface facilitates de-molding of the product after sintering.

It should be pointed out that the membrane making fixture and the sintering fixture used in the preparation method of the above second flexible porous metal foil can be completely same as those used in the preparation method of the above first flexible porous metal foil in structure, and the difference lies in that the carrier is placed on the template when the membrane making fixture for the second method is used, whereas a carrier is not placed on the template when the membrane making fixture for the first method is used; placed in the mold cavity of the sintering fixture for the second method is the carrier (having an asymmetrical structure) carrying the membrane, whereas placed in the mold cavity of the sintering fixture for the first method is the homogeneous membrane.

The present invention will be further described below in combination with accompanying drawings and specific embodiments. Additional aspects and advantages of the present invention will be given partially in the description below, and a part will be obvious from the following description or can be known via practice of the present invention.

DETAILED DESCRIPTION OF THE EMBODIMENTS

Figure 1:
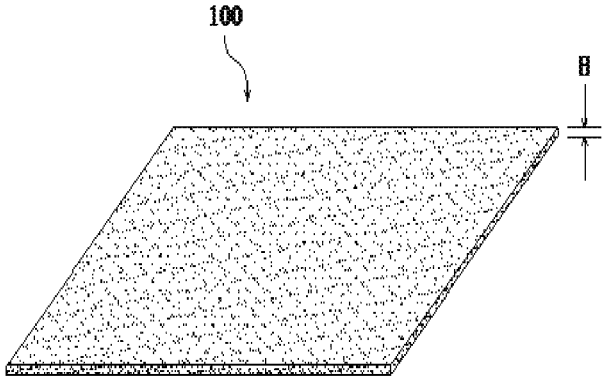
FIG. 1 is an appearance schematic diagram of a rectangular flexible porous metal foil in a specific embodiment of the present invention.

A flexible porous metal foil 100 shown in FIG. 1 is a sheet made of a metal porous material using a solid solution alloy, a face-centered cubic elemental metal or a body-centered cubic elemental metal as the matrix phase, the thickness H of the sheet is 5~200 μm, the average aperture is 0.05~100 μm, the porosity is 15~70%, and the sheet is formed by sintering a homogeneous membrane. The sheet may be rectangular as shown in FIG. 1, and may also be circular, elliptical or in other plane shape.

A preparation method of the flexible porous metal foil 100 includes the steps of: (1) preparing a viscous suspension from raw powder constituting a metal porous material by using a dispersant and an adhesive; (2) injecting the suspension into a mold cavity of a membrane making fixture, and drying the suspension to form a homogeneous membrane; and (3) charging the membrane into a sintering fixture matched with the membrane in shape, then performing constrained sintering, and taking the flexible porous metal foil 100 out of the sintering fixture and obtaining the foil after sintering.

In the above method, the dispersant may be an organic solvent which has small surface tension and is quick to volatilize and easy to dry, such as ethanol, methyl ethyl ketone, toluene, etc.; and the adhesive may be PVB (Polyvinyl Butyral), PVA (Polyvinyl Acetate), PVC (Polyvinyl Chloride), polyvinyl alcohol, polyethylene glycol (low molecular wax), paraffin, fatty acid, aliphatic amide, ester, etc.

In the above method, the proportion of the raw powder and the dispersant can be determined according to the specific components of the raw powder in order to ensure the surface quality of the dried membrane. Generally, if the content of the raw powder is too high, the surface quality of the dried membrane is poor, and the phenomena of cracking and the like easily occur; and if the content of the raw powder is too low, the number of injecting the suspension into the mold cavity of the membrane making fixture later is increased, and the preparation cycle of the flexible porous metal foil is prolonged.

In the above method, the proportion of the adhesive and the dispersant can be determined according to the specific components of the raw powder in order to ensure the surface quality of the dried membrane and the strength of the membrane. Generally, if the content of the adhesive is too high, the flowability of the suspension is poor, the defects of pore shrinkage and the like are easily produced after drying, and the de-molding after sintering is difficult; and if the content of the adhesive is too low, the powder particles of the raw material powder cannot be effectively adhered, and the membrane is poor in molding property, low in strength and difficult to take out.

In the above method, the constrained sintering means sintering on the premise that the sintering fixture keeps the shape of the membrane, thus preventing the membrane from being deformed in the sintering process. The specific sintering process shall be determined according to the specific components of the raw powder and the achieved pore structure.

Figure 2:
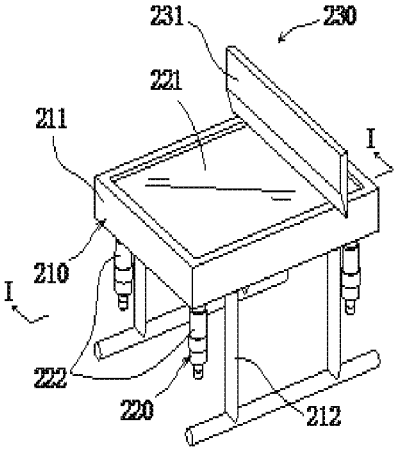
FIG. 2 is a schematic diagram of a three-dimensional structure of a membrane making fixture for preparing the flexible porous metal foil shown in FIG. 1.
Figure 3:
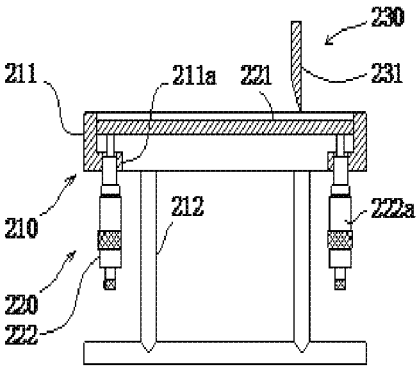
FIG. 3 is a section view of FIG. 2 in the I-I direction.

The membrane making fixture as shown in FIG. 2 and FIG. 3 can be used in step 2 of the above method. Specifically, the membrane making fixture includes a fixing portion 210, an adjusting portion 220 and a movable portion 230, wherein the fixing portion 210 includes a mold frame 211 for forming the edge of the membrane, and the mold frame 211 is installed on a supporting base 212 for supporting the mold frame 211 (of course, the mold frame 211 may also be fixed in other manner); the adjusting portion 220 includes a template 221 matched with the mold frame 211 and used for forming the bottom of the membrane, and the template 221 is connected with adjusting devices 222 enabling the template 221 to move in the depth direction of the mold frame 211; and the movable portion 230 includes a scraper 231 positioned on the top surface of the mold frame 211 and having the cutting edge flush with the top surface of the mold frame 211 in the working process. When the flexible porous metal foil 100 is rectangular as shown in FIG. 1, the inner cavity of the mold frame 211 is also rectangular, and the template 221 is located in the inner cavity and matched with the rectangular inner cavity. In addition, each adjusting device 222 specifically can include a height adjusting mechanism 222*a* (e.g., a spiral lifting mechanism below each of four corners of the bottom of the template 221) which is fixed relative to the mold frame 211 and connected with one of four corners of the bottom of the template 221 and works independently. To facilitate the installation of the height adjusting mechanisms 222*a*, supporting structures 211*a* extending inwards are also arranged at the bottom of the mold frame 211, and the height adjusting mechanisms 222*a* are installed on the supporting structures 211*a*.

A using method of the membrane making fixture includes: adjusting the template 221 to a set height and to parallel to the top surface of the mold frame 211 by adjusting each height adjusting mechanism 222*a*, then arranging a Vaseline coating on the molding surface of the mold frame 211 and the molding surface of the template 221 respectively (adjusting the template 221 to a position where the top surface of the template 221 is 20 μm lower than the top surface of the mold frame 211, then filling the mold cavity formed by the mold frame 211 and the template 221 with Vaseline, moving the scraper 231 while ensuring its cutting edge is flush with the top surface of the mold frame 211 to scrape off the Vaseline on the top surface of the mold frame 211, and finally correspondingly lowering the template 221 according to the design thickness of the membrane), injecting the suspension obtained in step (1) into the mold cavity formed by the mold frame 211 and the template 221, next, moving the scraper 231 while ensuring its cutting edge is flush with the top surface of the mold frame 211 to scrape off the suspension on the top surface of the mold frame 211, drying the suspension to form a membrane having uniform thickness, and finally taking the membrane out of the membrane making fixture. The membrane making fixture can accurately control the thickness of the membrane, and ensures the thickness uniformity and surface flatness of the membrane.

Figure 4:
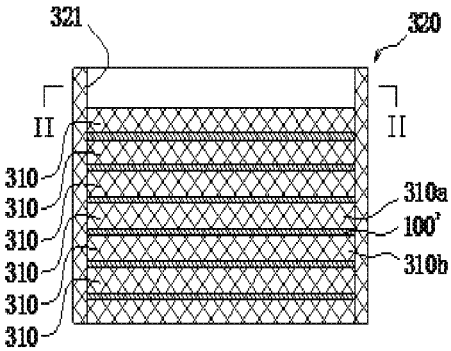
FIG. 4 is a structural schematic diagram of a membrane sintering fixture for preparing the flexible porous metal foil shown in FIG. 1.
Figure 5:
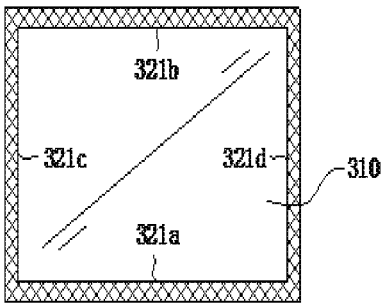
FIG. 5 is a section view of FIG. 4 in the II-II direction.

The membrane sintering fixture as shown in FIG. 4 and FIG. 5 can be used in step 3 of the above method. Specifically, the membrane sintering fixture includes an upper mold 310*a*, a lower mold 310*b* and a side mold 320 made of graphite, and the upper mold 310*a* and the lower mold 310*b* are respectively matched with the side mold 320 to form the mold cavity matched with the internal membrane 100'; wherein, the side mold 320 is specifically a mask 321, the upper mold 310*a* and the lower mold 310*b* are respectively clamping plates 310, multiple layers of clamping plates 310 are installed in the mask 321, and the mold cavity is formed between any two adjacent layers of clamping plates 310; besides, a fit clearance for emitting sintered volatile matters is reserved at the fit part of each clamping plate 310 and the mask 321. When the flexible porous metal foil 100 is rectangular as shown in FIG. 1, the side of the mask 321 is of a rectangular structure formed by a front plate 321*a*, a rear plate 321*b*, a left plate 321*c* and a right plate 321*d*.

A using method of the membrane sintering fixture includes: arranging an alumina coating on the inner wall of the mask 321 and two side walls of each clamping plate 310 (mixing ethanol, PVB and alumina powder to prepare a viscous alumina powder suspension, and then coating the inner wall of the mask 321 and two side walls of each clamping plate 310 with the alumina powder suspension to form the alumina coating), then laying a bottom clamping plate 310 at the bottom of the mask 321, placing a membrane 100' on the clamping plate 310, laying a second layer of clamping plate 310 on the membrane 100', laying all the remaining clamping plates 310 like this while ensuring a membrane 100' is sandwiched between any two adjacent layers of clamping plates 310, feeding the assembled membrane sintering fixture into a sintering furnace for sintering, and taking the flexible porous metal foil 100 out of the membrane sintering fixture after sintering. The membrane sintering fixture realizes simultaneous constrained sintering of a plurality of membranes 100', thus improving the production efficiency and simultaneously ensuring the sintering consistency.

Another flexible porous metal foil of the present invention is a sheet made of a metal porous material using a solid solution alloy as the matrix phase, the thickness H of the sheet is 5~200 μm, the average aperture is 0.05~100 μm, and the porosity is 15%~70%. The sheet may be rectangular, and may also be circular, elliptical or in other plane shape.

A preparation method of the second flexible porous metal foil includes the steps of: (1) preparing a carrier, wherein the carrier is a foil formed by a certain element or a few elements in a metal porous material for forming the flexible porous metal foil; (2) preparing a viscous suspension from raw powder of the remaining elements constituting the metal porous material by using a dispersant and an adhesive; (3) coating the surface of the carrier with the suspension, and drying the suspension to form a membrane attached to the surface of the carrier; and (4) charging the carrier carrying the membrane into a sintering fixture matched with the carrier in shape, then performing constrained sintering, and taking the flexible porous metal foil out of the sintering fixture.

In the above method, the dispersant may be an organic solvent which has small surface tension and is quick to volatilize and easy to dry, such as ethanol, methyl ethyl ketone, toluene, etc.; and the adhesive may be PVB, PVA, PVC, polyvinyl alcohol, polyethylene glycol (low molecular wax), paraffin, fatty acid, aliphatic amide, ester, etc.

In the above method, the proportion of the raw powder and the dispersant can be determined according to the specific components of the raw powder in order to ensure the surface quality of the dried membrane. Generally, if the content of the raw powder is too high, the surface quality of the dried membrane is poor, and the phenomena of cracking and the like easily occur; and if the content of the raw powder is too low, the number of injecting the suspension into the mold cavity of the membrane making fixture later is increased, and the preparation cycle of the flexible porous metal foil is prolonged.

In the above method, the proportion of the adhesive and the dispersant can be determined according to the specific components of the raw powder in order to ensure the surface quality of the dried membrane and the strength of the membrane. Generally, if the content of the adhesive is too high, the flowability of the suspension is poor, the defects of pore shrinkage and the like are easily produced after drying, and the de-molding after sintering is difficult, and if the content of the adhesive is too low, the raw powder particles cannot be effectively adhered, and the membrane is poor in molding property, low in strength and difficult to take out.

In the above method, the constrained sintering means sintering on the premise that the sintering fixture keeps the shape of the membrane, thus preventing the membrane from being deformed in the sintering process. The specific sintering process shall be determined according to the specific components of the raw powder and the achieved pore structure.

The suspension can be attached to the surface of the carrier by coating or the like in step 3 of the above method, but it is suggested that the suspension is attached to the surface of the carrier by using the membrane making fixture shown in FIG. 2 and FIG. 3. The specific method includes: adjusting the template 221 to a set height and to parallel to the top surface of the mold frame 211 by adjusting each height adjusting mechanism 222*a*, then laying a carrier on the template 221, injecting the suspension obtained in step (2) into the mold cavity between the mold frame 211 and the carrier, next, moving the scraper 231 while ensuring its cutting edge is flush with the top surface of the mold frame 211 to scrape off the suspension on the top surface of the mold frame 211, drying the suspension to form a membrane having uniform thickness, and finally taking the carrier carrying the membrane out of the membrane making fixture.

The membrane sintering fixture shown in FIG. 4 and FIG. 5 is also used in step 4 of the above method.

Embodiment 1

The flexible porous metal foil 100 is a rectangular sheet made of a Ni—Cu solid solution alloy porous material, the thickness H of the sheet is 10 μm, the length is 160 mm, the width is 125 m, the average aperture is 18.4 μm, and the porosity is 58.37%. A preparation method of the flexible porous metal foil 100 includes the steps of: firstly, mixing Ni powder and Cu powder uniformly to form raw powder mixture, wherein the mass of the Cu powder is 30% of the mass of the mixture; then taking ethanol as a dispersant and PVB as an adhesive, adding the PVB into the ethanol in a mass ratio of 2.5:100 to form a PVB solution, adding the mixture into the PVB solution according to a proportion of adding 25 g of the mixture into per 100 ml of ethanol, and dispersing the mixture uniformly by stirring to obtain a viscous suspension; secondly, injecting the suspension into the mold cavity of the membrane making fixture shown in FIG. 2 and FIG. 3, and drying the suspension to form a homogeneous membrane 100'; and finally, charging the membrane 100' into the membrane sintering fixture shown in FIG. 4 and FIG. 5, performing a specific sintering process of gradually raising the sintering temperature to 550° C. with the holding time of 90 mins (this process is mainly used for removing the adhesive, Vaseline, etc.), then directly raising the temperature to 1130° C. at the heating rate of 6° C./min with the holding time of 180 mins (when the temperature is quickly raised to 1170° C. and exceeds the melting point of Cu, the Ni powder can be driven by using the flowability after the Cu is melted, so that the Ni powder is sufficiently combined, and the integrity and flexibility of the flexible porous metal foil 100 are ensured), and taking the flexible porous metal foil 100 out of the sintering fixture after sintering.

Embodiment 2

The flexible porous metal foil 100 is a rectangular sheet made of a Ni—Cu solid solution alloy porous material, the thickness H of the sheet is 100 μm, the length is 200 mm, the width is 130 mm, the average aperture is 30 μm, and the porosity is 61.68%. A preparation method of the flexible porous metal foil 100 includes the steps of: firstly, mixing Ni powder and Cu powder uniformly to form raw powder mixture, wherein the mass of the Cu powder is 60% of the mass of the mixture; then taking ethanol as a dispersant and PVB as an adhesive, adding the PVB into the ethanol in a mass ratio of 4:100 to form a PVB solution, adding the mixture into the PVB solution according to a proportion of adding 40 g of the mixture into per 100 ml of ethanol, and dispersing the mixture uniformly by stirring to obtain a viscous suspension; secondly, injecting the suspension into the mold cavity of the membrane making fixture shown in FIG. 2 and FIG. 3, and drying the suspension to form a homogeneous membrane 100'; and finally, charging the membrane 100' into the membrane sintering fixture shown in FIG. 4 and FIG. 5, performing a specific sintering process of gradually raising the sintering temperature to 550° C. with the holding time of 90 min, then directly raising the temperature to 1180° C. at the heating rate of 8° C./min with the holding time of 180 min. and taking the flexible porous metal foil 100 out of the sintering fixture after sintering.

Embodiment 3

The flexible porous metal foil is a rectangular sheet made of a Ni—Cu solid solution alloy porous material, the thickness H of the sheet is 60 μm, the length is 150 mm, the width is 100 mm, the average aperture is 54.1 μm, and the porosity is 40.16%. A preparation method of the flexible porous metal foil includes the steps of: firstly, performing surface treatment on a Cu foil (carrier) having the purity more than 99% and the thickness of 10 μm; cleaning impurities such as oil stains and the like on the surface of the Cu foil by adopting 10% NaOH solution, and then performing acid washing on the Cu foil in 10% $H_2SO_4$ solution for 2 mins to remove oxides and rust stains on the surface of the Cu foil; secondly, soaking the Cu foil after alkali washing and acid washing into an acetone solution, cleaning the Cu foil with ultrasonic for 8 min, drying the Cu foil in a vacuum oven, and recording the mass of the Cu foil; thirdly, taking elemental Ni powder as a raw material, ethanol as a dispersant and PVB as an adhesive, adding the PVB into the ethanol in a mass ratio of 4:100 to prepare a PVB solution, then adding Ni powder into the PVB solution according to a proportion of adding 25 g of Ni powder into per 100 ml of ethanol, and dispersing the Ni powder uniformly by stirring to obtain a viscous suspension; and finally, sticking the Cu foil to the surface of the template 221 of the membrane making fixture, controlling the coating thickness by adjusting the height of the top surface of the template 221, then injecting the suspension into the mold cavity of the membrane making fixture, controlling the mass ratio of Ni to Cu to about 1:1, drying the suspension, charging the dried blank into the membrane sintering fixture shown in FIG. 4 and FIG. 5, and sintering the blank according to the same sintering process of embodiment 1.

The performance comparison results of the flexible porous metal foils of embodiments 1-3 are shown as table 1.

TABLE 1

Performance comparison results of flexible porous metal foils

| Item | | Embodiment 1 | Embodiment 2 | Embodiment 3 |
|---|---|---|---|---|
| Surface plane runout of foil (flatness) | | ≤5 μm | ≤0.36 μm | ≤0.56 μm |
| Aperture distribution | X ≤ 10 μm | 10% | 10% | 15% |
| | 10 μm < X < 80 μm | 50% | 85% | 70% |
| | X ≥ 80 μm | 40% | 5% | 15% |
| Folding endurance of foil | | Folded 7 times | Folded 16 times | Folded 14 times |

We claim:

1. A flexible porous metal foil is characterized in that it is a sheet made of a metal porous material using a solid solution alloy, a face-centered cubic elemental metal or a body -centered cubic elemental metal as the matrix phase, the thickness of the sheet is 5~200 μm, the average aperture is 0.05~100 μm, the porosity is 15%~70%, and the sheet is formed by sintering a homogeneous membrane, said flexible porous metal foil made by a process comprising:

preparing a viscous suspension from a powder of a first metallic element, a powder of a second, different metallic element, a dispersant and an adhesive;

injecting the viscous suspension into a mold cavity of a membrane making fixture to form a molded membrane;

drying the molded membrane to form a homogenous membrane; and sintering the homogenous membrane to form the flexible porous metal foil, wherein the sintering is performed at a sintering temperature that is between a first melting point of the first metallic element and a second, different melting point of the second, different metallic element.

2. The flexible porous metal foil of claim 1, wherein the sheet is made of a metal porous material using an infinite solid solution alloy as the matrix phase.

3. The flexible porous metal foil of claim 2, wherein the sheet is made of a metal porous material using Ag—Au solid solution, Ti—Zr solid solution, Mg—Cd solid solution or Fe—Cr solid solution as the matrix phase.

4. The flexible porous metal foil of claim 2, wherein the sheet is made of a Ni—Cu solid solution metal porous material, and the aperture differences of more than 75% of pores of the porous material are in the range of less than 70 μm.

5. The flexible porous metal foil of claim 1, wherein the sheet is made of a metal porous material using a finite solid solution alloy as the matrix phase.

6. The flexible porous metal foil of claim 5, wherein the sheet is made of a metal porous material using Cu—Al solid solution, Cu—Zn solid solution or Fe—C—Cr solid solution as the matrix phase.

7. The flexible porous metal foil of claim 1, wherein the sheet is made of a metal porous material having a face-centered cubic structure and using Al, Ni, Cu or Pb as the matrix phase.

8. The flexible porous metal foil of claim 1, wherein the sheet is made of a metal porous material having a body-centered cubic structure and using Cr, W, V or Mo as the matrix phase.

9. The flexible porous metal foil of claim 1 wherein the first metallic element and the second, different metallic element are chosen from a set of pairs consisting of:

silver (Ag) and gold (Au);

titanium (Ti) and zirconium (Zr);

magnesium (Mg) and cadmium (Cd);

iron (Fe) and chromium (Cr); and nickel (Ni) and copper (Cu).

* * * * *